US007703912B2

(12) United States Patent
Sootome et al.

(10) Patent No.: US 7,703,912 B2
(45) Date of Patent: Apr. 27, 2010

(54) CONVEYING APPARATUS AND RECORDING APPARATUS

(75) Inventors: Sumitoshi Sootome, Yachiyo (JP); Tadashi Matsumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 599 days.

(21) Appl. No.: 11/071,324

(22) Filed: Mar. 4, 2005

(65) Prior Publication Data

US 2005/0195264 A1 Sep. 8, 2005

(30) Foreign Application Priority Data

Mar. 8, 2004 (JP) ..... 2004-063983

(51) Int. Cl.
*B41J 2/01* (2006.01)

(52) U.S. Cl. ..... 347/104; 347/101

(58) Field of Classification Search ..... 347/104, 347/101; 271/116, 119; 400/625, 578; 346/134; 399/361; 371/119
See application file for complete search history.

(56) References Cited

U.S. PATENT DOCUMENTS 3,577,334 A * 5/1971 Graham et al. ..... 204/223
4,717,139 A 1/1988 Sootome et al. ..... 271/116
5,004,895 A * 4/1991 Nishino et al. ..... 219/528
5,571,265 A 11/1996 Yagi et al. ..... 271/119
5,631,725 A * 5/1997 Harasawa et al. ..... 399/66
5,722,654 A 3/1998 Sootome et al. ..... 271/119
5,736,017 A * 4/1998 Moriguchi et al. ..... 204/253
5,821,968 A * 10/1998 Ohyama et al. ..... 347/104
5,896,154 A * 4/1999 Mitani et al. ..... 347/102
5,943,081 A * 8/1999 Uchida et al. ..... 347/104
6,092,891 A * 7/2000 Okubo et al. ..... 347/104
6,097,408 A * 8/2000 Fukushima et al. ..... 347/34
6,139,140 A * 10/2000 Rasmussen et al. ..... 347/104
6,164,761 A * 12/2000 Numata ..... 347/55
6,298,586 B1 * 10/2001 Todome ..... 399/303
6,309,064 B1 * 10/2001 Tanno et al. ..... 347/104
6,328,440 B1 * 12/2001 Medin et al. ..... 347/102
6,336,722 B1 * 1/2002 Wotton et al. ..... 347/102
6,375,318 B1 * 4/2002 Johnson ..... 347/102
6,457,888 B1 10/2002 Matsumoto ..... 400/625
6,511,172 B2 * 1/2003 Tanno et al. ..... 347/104
6,652,938 B1 * 11/2003 Nishikawa et al. ..... 428/35.9
6,712,463 B2 3/2004 Matsumoto ..... 347/104
6,715,872 B2 * 4/2004 Kanome ..... 347/104
6,792,220 B2 * 9/2004 Randall et al. ..... 399/49
6,801,749 B2 * 10/2004 Yasui et al. ..... 399/401
7,175,269 B2 * 2/2007 Kito ..... 347/106
2003/0063174 A1 * 4/2003 Kanome ..... 347/104

* cited by examiner

*Primary Examiner*—Stephen D Meier
*Assistant Examiner*—Leonard S Liang
(74) *Attorney, Agent, or Firm*—Fitzpatrick, Cella, Harper & Scinto

(57) ABSTRACT

A feeding device includes a conveying member for conveying a recording material; and an electrode, disposed in the conveying member, for generating an electrostatic attraction force for electrostatic attraction of the recording material on the conveying member and for controlling a temperature of a surface layer of the conveying member to provide a substantially constant resistance value of the surface layer of the conveying member.

3 Claims, 11 Drawing Sheets

(a)

(b)

CONVEYING APPARATUS AND RECORDING APPARATUS

FIELD OF THE INVENTION AND RELATED ART

The present invention relates to a conveying apparatus which comprises a recording medium bearing member and conveys recording medium while keeping the recording medium adhered to the recording medium bearing member. It also relates to a recording apparatus comprising this conveying apparatus.

Generally speaking, an ink jet recording apparatus is an apparatus which records an image by ejecting ink from its recording head onto recording medium. An ink jet recording head has various advantages. For example, it is easy to reduce in size, is capable of recording a highly precise image at a high speed, and is low in operational cost. Further, it is impact free, being therefore small in operational noise, and can be easily devised to record a color image with the use of a plurality of inks different in color. Of the various types of an ink jet recording apparatus, a recording apparatus of the full-line type, which has a recording head having a large number of ejection orifices aligned in the direction perpendicular to the direction in which recording medium is conveyed, is especially fast in recording speed.

However, in the case of a recording apparatus of the full-line type, in particular, a recording apparatus of the full-line type, the plurality of recording heads of which are aligned in parallel in the direction in which recording medium is conveyed, the distance from the most upstream recording to the most downstream recording head is substantial, allowing the recording medium to float in the recording area. This floating of the recording medium possibly results in the formation of a defective image, recording medium jam, or the like problem. Therefore, it is necessary to keep the recording medium pressured downward in order to prevent the recording medium from floating. As for the concrete means for keeping the recording medium pressured downward, there has been known the method in which electrodes are disposed in the adjacencies of the recording medium path, and the floating of the recording medium is prevented by adhering the recording medium with the electrostatic force generated by providing the electrodes with electric charge.

An ink jet recording apparatus in accordance with the prior art is generally structured as follows: The recording medium is fed into the main assembly of the recording apparatus by a paper feeding apparatus, and is conveyed to the recording portion, through which the recording medium is conveyed, being kept adhered to the top surface of the conveyer belt by the adhesive force generated by an adhesive force generating apparatus embedded in the recording medium conveying member (conveyer belt), while recording is made on the surface of the recording medium by the recording head.

At this time, referring to FIGS. 12-15, the conveyer belt and adhesive force generating apparatus such as those disclosed in Japanese Laid-open Patent Application Hei 11-151843 will be described. First, referring to FIG. 12, the conveyer belt and its adjacencies will be described regarding their structures. As shown in FIG. 12, the conveyer belt 131 of the conveying portion 103 is a roughly 0.1 mm-0.2 mm thick endless belt formed of synthetic resin such as polyethylene, carbonate, etc. It moves while bearing a recording paper P. Next, referring to FIGS. 13-15, the conveyer belt 131 is provided with an adhesive force generating apparatus 136, which will be described later. This adhesive force generating apparatus 136 is an apparatus for generating electrostatic adhesive force in the conveyer belt 131 by applying roughly 0.5 kV-10 kV of voltage to a power supply brush 152 (FIG. 12), which is in contact with the conveyer belt 131, in the recording area located below the recording heads 107K, 107C, 107M, and 107Y. The power supply brush 152 is connected to a high voltage power source (unshown) which generates a predetermined high voltage.

Rollers 132, 134, and 135 provide the conveyer belt 131 with a proper amount of tension while supporting it. The roller 134 is connected to a paper conveyance motor 160. A supporting member 139 for supporting a paper pressing roller 140 is attached to the rotational axle of a pinch roller 133 so that the supporting member 139 is allowed to rotate about the axial line of the rotational axle of the pinch roller 133. The paper pressing roller 140 as a member for keeping the recording paper P pressed upon the conveyer belt 131 is rotatably attached to the supporting member 139. The paper pressing roller 140 is kept pressured toward the conveyer belt 131 by an unshown pressure generating member.

A pair of cleaning rollers 138 are disposed so that they apply pressure to the conveyer belt 131 by pinching them. They are enabled to absorb ink so that the contamination such as ink having adhered to the conveyer belt 131 is removed by the pair of cleaning rollers 138. For durability, the pair of cleaning rollers 138 are formed of sponge, the foams of which are continuous and small in diameter (10 μm-30 μm is preferable). The conveying portion is also provided with a charge removal brush 137, which is an apparatus for removing electrical charge from the conveyer belt 131 after the conveyer belt 131 is cleaned by the pair of cleaning rollers 138.

There is a two-sided printing path below the conveyer belt 131, which makes is possible to print on both sides of the recording paper P; after the completion of the printing of an image on one surface of the recording paper P, the recording paper P is further conveyed until the trailing edge of the recording paper P reaches the contact area between a discharge roller and a spur roller. Then, as soon as the recording paper P reaches the contact area, the discharge roller is reversed in the rotational direction to introduce the recording paper P into the two-sided printing path so that the recording paper P will be conveyed through the contact area between the conveyer roller and pinch roller to be placed on the conveyer belt 131, for the second time, to print an image on the other surface of the recording paper P.

Next, referring to FIGS. 13-15, the adhesive force generating apparatus 136 will be described. FIG. 13 is a plan view of the recording medium conveying portion, as seen from the direction indicated by an arrow mark f in FIG. 12, and depicts the pattern in which the electrodes of the adhesive force generating apparatus with which the conveying portion is provided are arranged. FIG. 14 is a sectional view of the portion of the conveying portion, at a line a-a in FIG. 13, and FIG. 15 is a sectional view of the portion of the conveying portion, at a line b-b in FIG. 13.

As will be evident from FIGS. 13-15, the conveying portion is provided with an apparatus 136 for generating electrostatic force. More specifically, long, narrow, and flat electrodes 136*a* (which hereinafter will be referred to simply as electrodes 136*a*) formed of electrically conductive metallic substance, and a plurality of long, narrow, and flat electrodes 136*b* (which hereinafter will be referred to simply as ground electrodes 136*b*) formed also of electrically conductive metallic substance. More specifically, referring to FIG. 13, the conveyer belt 131 is implanted with a set of electrodes 136*a*, which extend from one of the edges of the conveyer belt 131 in the direction perpendicular to the direction in which the conveyer belt 131 is moved, and a set of electrodes 136*b*, which extend from the other edge of the conveyer belt 131 in the direction perpendicular to the direction in which the conveyer belt 131 is moved. The two sets of electrodes 136*a* and 136*b* are positioned so that each electrode 136*a* and 136*b* alternate in position in terms of the moving direction of the conveyer belt 131.

The end portion of each of the electrodes 136*a*, which is located adjacent to one of the edges of the conveyer belt 131, is widened, constituting a terminal 136*a'*, and the end portion of each of the electrodes 136*b*, which is located adjacent to the other edge of the conveyer belt 131, is widened, constituting a terminal 136*b'*. The terminals 136*a*' and terminal 136*b*' are exposed, constituting the portions through which the electrodes 136*a* and 136*b* are supplied with power. Further, the conveying portion is provided with a pair of electrically conductive power supply brushes 152 (FIG. 12) which are kept in contact with the conveyer belt 131, with the presence of a predetermined amount of contact pressure, so that they will be placed in contact with the terminals 136*a*' and 136*b*' to apply positive or negative voltage to the terminal 136*a*' of the electrodes 136*a*. The terminal 136*b*' of each electrode 136*b* is grounded. Referring to FIGS. 14 and 15, the adhesive force generating apparatuses 136 comprising the electrode 136*a* and ground electrode 136*b* are sandwiched, being thereby protected, between the base and surface layers 136*c* and 136*d*, respectively, of the conveyer belt 131, formed of synthetic resin such as polyethylene, poly-carbonate, etc., across the adhesive force generating range. In other words, the conveyer belt 131 is implanted with a plurality of adhesive force generating apparatuses 136.

As voltage is applied to the electrode 136*a*, electrostatic force is generated in the direction indicated by an arrow mark in FIG. 14; an electric field indicated by the arrow marks is generated. As a result, the difference in electrical potential between the electrode plate 136*a* and ground electrode 136*b* induces electrostatic adhesive force above the conveyer belt 131; it induces, on the surface of the recording paper P, electric charge (surface potential) identical in polarity to the voltage applied to the electrode plate 136*a*. The electrostatic force which functions to adhere the recording paper P to the conveyer belt 131 is smallest in the area corresponding to the portion of the conveyer belt 131 between the electrode 136*a* and ground electrode 136*b*, that is, the portion of the conveyer belt 131 in which the electrical conductive metal is not present.

Next, referring to FIGS. 12-15, the working of the conveying portion will be described regarding the adhesion and conveyance of recording medium. The recording paper P is placed on the conveyer belt 131 by the conveyance roller 132 and pinch roller 133, and is pressed upon the conveyer belt 131 by the pressing roller 140, while remaining pinched by the two rollers 132 and 133. Then, the recording paper P is adhered, and remains adhered, to the flat portion of the conveyer belt 131 by the electrostatic adhesive force generated by the adhesive force generating means 136, while it is conveyed to the recording portion by the rotation of the conveyer belt 131, and also while it is conveyed through the recording station by the rotation of the conveyer belt 131 to form an image on the recording paper P by recording heads 107K, 107C, 107M, and 107Y. The conveyer belt 131 is moved in the direction indicated by an arrow mark A by the functions of the paper conveyance motor 160 and roller 134; the recording paper P is conveyed in the direction of the arrow mark A.

As ink is ejected onto the recording paper P by a large amount, the portions of the recording paper P sometimes are made to swell by the ink they absorbs, causing thereby the recording paper P to become wavy (causing recording paper P to cockle). However, with the presence of the electrostatic adhesive force generated by the adhesive force generating apparatus 136, the recording paper P is kept adhered to the conveyer belt 131, being thereby prevented from floating toward the recording heads 107K, 107C, 107M, and 107Y. Therefore, it does not occur that the recording paper P comes into contact with any of the recording heads 107B, 107M, 107C, and 107Y while recording is made on the recording paper P. Therefore, recording is reliably made.

Also with the presence of the electrostatic adhesive force from the adhesive force generating apparatus 136, even after the recording paper P becomes wavy or curly, across some portions, due to the changes in such an ambient factors as temperature or humidity, the recording paper P is conveyed to the adhesive force generation area, while being pressed flat on the conveyer belt 131 by the paper pressing roller 140, that is, while the recording paper P is prevented by the paper pressing roller 140 from remaining wavy or curly. Therefore, the recording paper P is reliably kept flatly adhered to the conveyer belt 131 in the recording portion.

SUMMARY OF THE INVENTION

In recent years, it has been demanded, in the field of an ink jet recording apparatus that in order to obtain a highly precise image, the recording paper P is conveyed at a high level of accuracy, that is, with the gaps between the recording paper P and each of the recording heads 107K 107M, 107C, and 107Y kept constant at a very small value (for example, 0.5 mm-1.5 mm). In particular, in the case of a high speed recording apparatus of the single pass type, that is, a recording apparatus employing a line head, the gap between the recording paper P and each of the recording heads 107K, 107M, 107C, and 107Y is one of the primary factors that directly affect image quality. Thus, the gap has been continuously reduced. As the gap has been continuously reduced, it has become more important to prevent the recording paper P from becoming wavy and/or curly when ink is ejected onto the recording paper P by a large amount, in particular, in the one sided printing mode. Therefore, it is desired more than ever to achieve a greater amount of force for adhering, and keeping adhered, the recording paper P to the conveyer belt 131, by the conveyer belt 131 itself. Further, in the case of the means for electrostatically adhering the recording paper P to the conveyer belt 131, the adhesive force sometimes reduces due to the changes in adhesive conditions attributable to the changes in the ambience in which the conveyer belt 131 was used. Therefore, it has been desired to reliably achieve a greater amount of electrostatic adhesive force.

The above described problems do not concern the conveyer belt 131 alone. That is, there is the possibility that problems similar to the above described problems also occur to a recording medium bearing member in a form other than a belt; for example, a recording medium bearing member in the form of a rigid drum.

Thus, the primary object of the present invention is to provide a conveying apparatus capable of reliably conveying recording medium, by adhering recording medium to its recording medium bearing member, even if the recording medium deforms (for example, cockles) due to the changes in the ambience in which the recording apparatus is used, and/or the swelling of the portions of the recording medium attributable to the recording liquid absorption, and to provide a recording apparatus comprising such a conveying apparatus.

The present invention is characterized in that a conveying apparatus having a recording medium bearing member for conveying the recording medium is implanted with a plurality of electrodes having the function of generating electrostatic force for electrostatically adhering the recording medium to the recording medium bearing member, and the temperature controlling function of keeping constant the electrical resistance of the surface layer of the recording medium bearing member.

The present invention makes it possible to reliably convey recording medium by preventing recording medium from fluttering and/or floating due to the insufficiency in the force for keeping the recording medium adhered to the recording medium bearing member, during recording medium conveyance.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiment of the present invention will be described with reference to the appended drawings.

Embodiment 1

Figure 1:
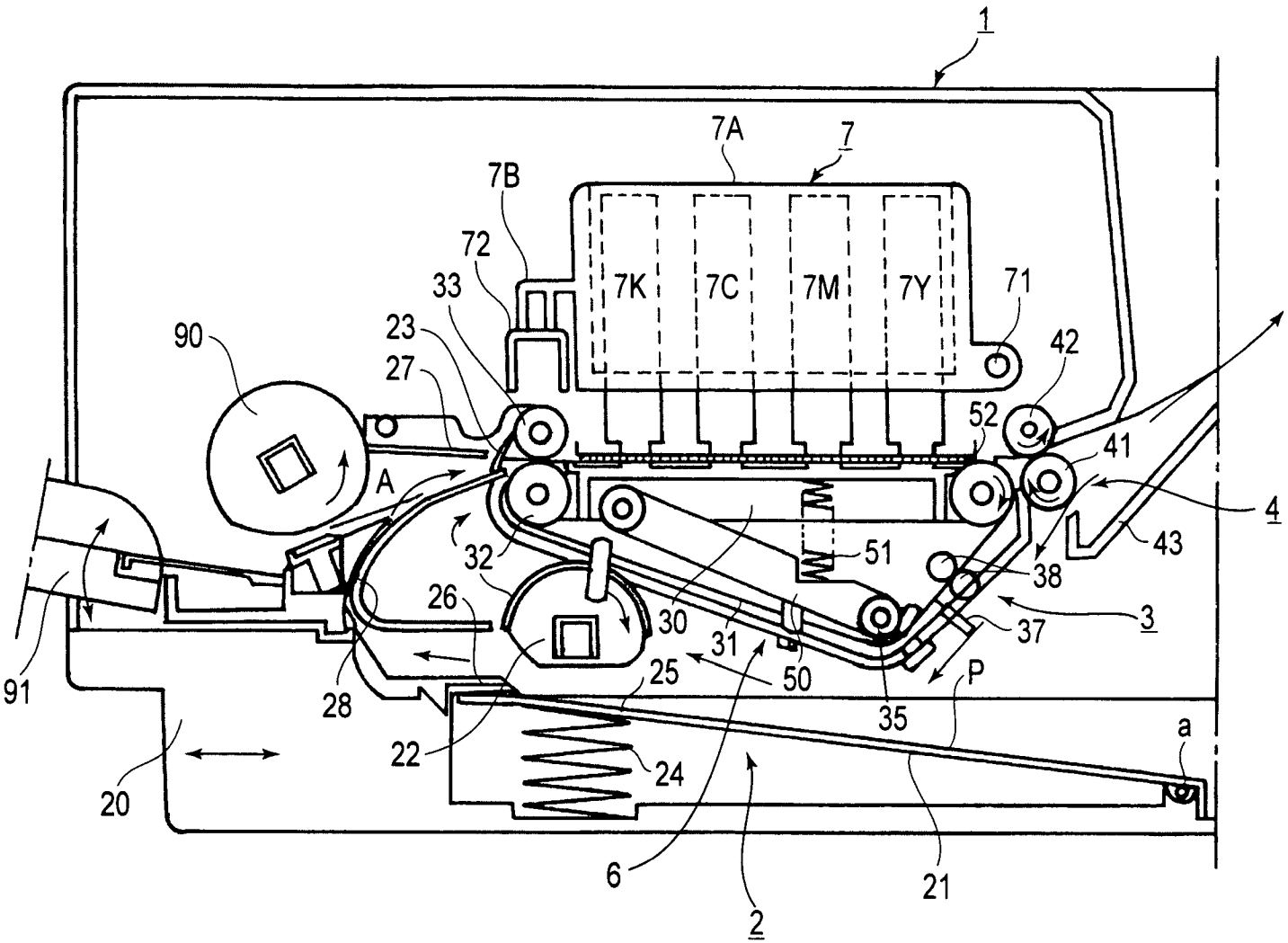
FIG. 1 is a sectional view of the recording apparatus in the first embodiment of the present invention, showing the general structure thereof.

First, the recording apparatus equipped with the recording medium conveying apparatus in the first embodiment of the present invention will be described with reference to the appended drawings. FIG. 1 is a sectional view of the recording apparatus in this embodiment, showing the general structure thereof. This recording apparatus 1 has a recording paper feeding portion 2, a conveying portion 3 (conveying apparatus), a recording portion 7 (image forming apparatus), a recording paper discharging portion 4, and a two-sided printing path 6.

The recording paper feeding portion 2 comprises a base 20, a pressure plate 21 on which a plurality of recording papers P as recording mediums are mounted in layers, and a rotatable member 22 for feeding the recording paper P. The pressure plate 21 and recording paper feeding rotatable member 22 are attached to the base 20. The pressure plate 21 is attached to the base 20, being enabled to rotate about the rotational axle a, by which the pressure plate 21 is attached to the base 20, and is kept pressured by the compression leaf spring 24 toward the recording paper feeding rotatable member 22. The pressure plate 21 is provided with a separation pad 25, which is attached to the portion of the pressure plate 21, which opposes the recording paper feeding rotatable member 22. The separation pad 25 is formed of such a material as artificial leather or the like, which is high in coefficient of friction. The base 20 is provided with a separation claw 26 for separating one by one the recording papers P, and an unshown release cam for separating, and keeping separated, the pressure plate 21 from the recording paper feeding rotatable member 22.

Further, the recording apparatus 1 is provided with a recording paper feeding rotatable member 90 for hand-feeding the recording paper P, which feeds the recording paper P on a manual feed tray 91 to the conveyance roller 32 of the conveying portion 3, in response to a recording command signal from an external computer or the like.

Figure 2:
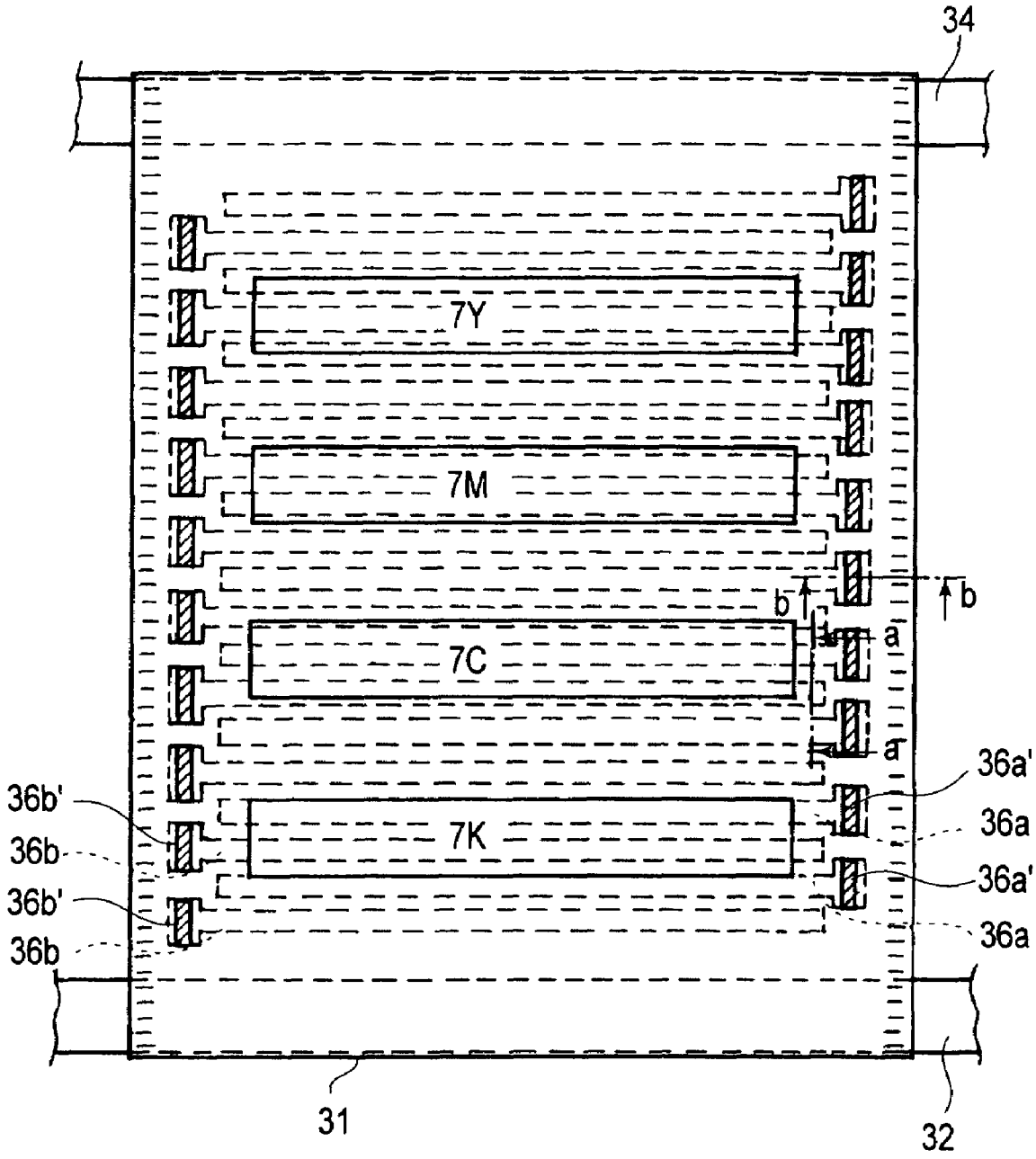
FIG. 2 is a plan view of the conveying portion of the recording apparatus in FIG. 1.
Figure 3:
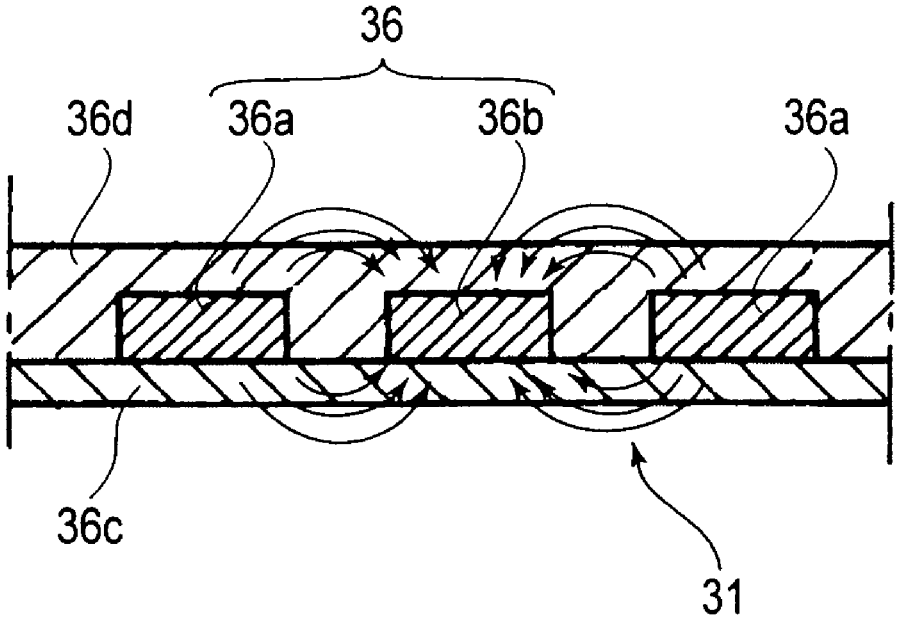
FIG. 3 is a sectional view of the portion of the conveying portion, at a line a-a in FIG. 2.
Figure 4:
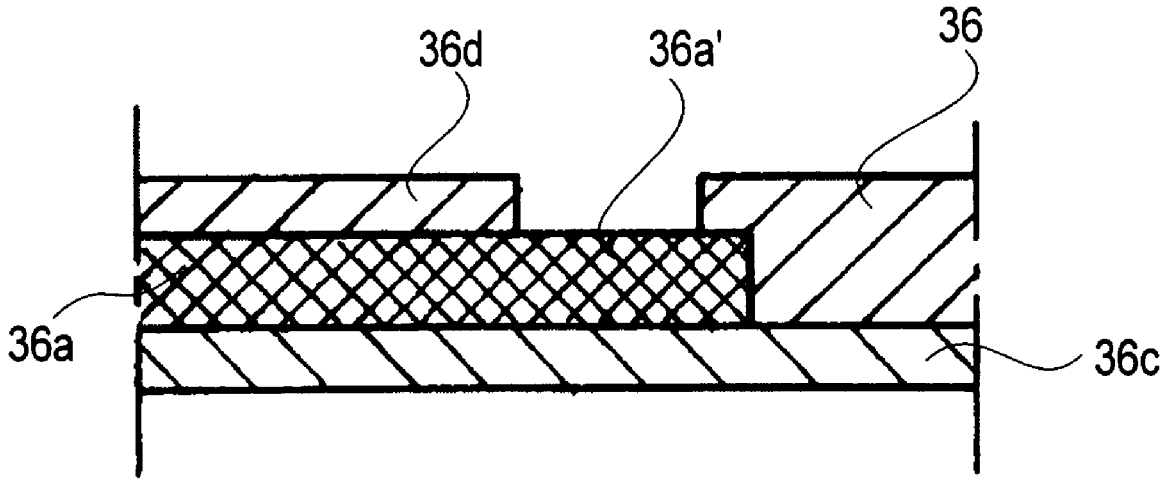
FIG. 4 is a sectional view of the portion of the conveying portion, at a line b-b in FIG. 2.

The conveying portion 3 is also provided with a conveyer belt 31, which conveys the recording paper P while keeping the recording paper P adhered to the conveyer belt 31. Referring to FIGS. 2-4, the conveying portion 3 in this embodiment is also provided with an adhesive force generating apparatus 36. That is, the conveyer belt 31 in this embodiment comprises an adhesive force generating apparatus 36, a base layer 36*c*, and a surface layer 36*d*, as was the typical conveyer belt in accordance with the prior art described above structured. More specifically, the adhesive force generating apparatus 36 is made up of two sets of electrodes, that is, a set of long, narrow, and flat electrodes 36*a* (which hereinafter will be referred simply as electrodes 36*a*) extending from the adjacencies of one edge of the conveyer belt 31 to the adjacencies of the other edge, like the teeth of a comb, and a set of long, narrow, and flat ground electrodes 36*b* (which hereinafter will be referred to simply as ground electrodes 36*b*) extending from the adjacencies of the opposite edge of the conveyer belt 31 to the adjacencies of the other edge, also like the teeth of a comb. The conveyer belt 31 is wrapped around a driver roller 34, a conveyance roller 32 as a follower roller, and a tension roller 35, being suspended by them, and is driven by the driver roller 34.

Figure 6:
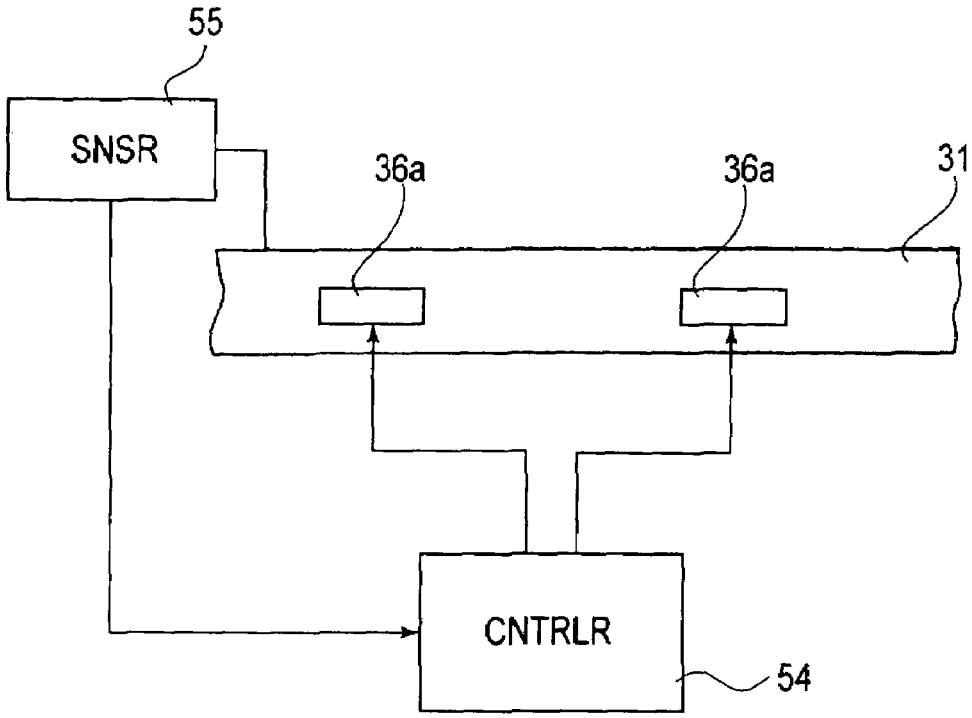
FIG. 6 is a block diagram of the essential portions of the conveying portion of the recording apparatus in FIG. 1.

The conveyer belt 31 is roughly 0.1 mm-0.2 mm in thickness, and is formed of synthetic resin such as polyethylene or poly-carbonate. It is an endless belt. It bears and moves the recording paper P while keeping the recording paper P adhered thereto. The conveyer belt 31 is implanted with the adhesive force generating apparatus 36. As roughly 0.5 kV-10 kV of voltage is applied to a power supply brush 52 which is in contact with the conveyer belt 31, the adhesive force generating apparatus 36 generates electrostatic force which acts in the direction to attract the recording paper P to the conveyer belt 31. The power supply brush 52 is connected to a high voltage power source (unshown) which generates a predetermined high voltage. The high voltage power source and power supply brush 52 belong to a voltage supply control portion 54 (FIG. 6).

Figure 7:
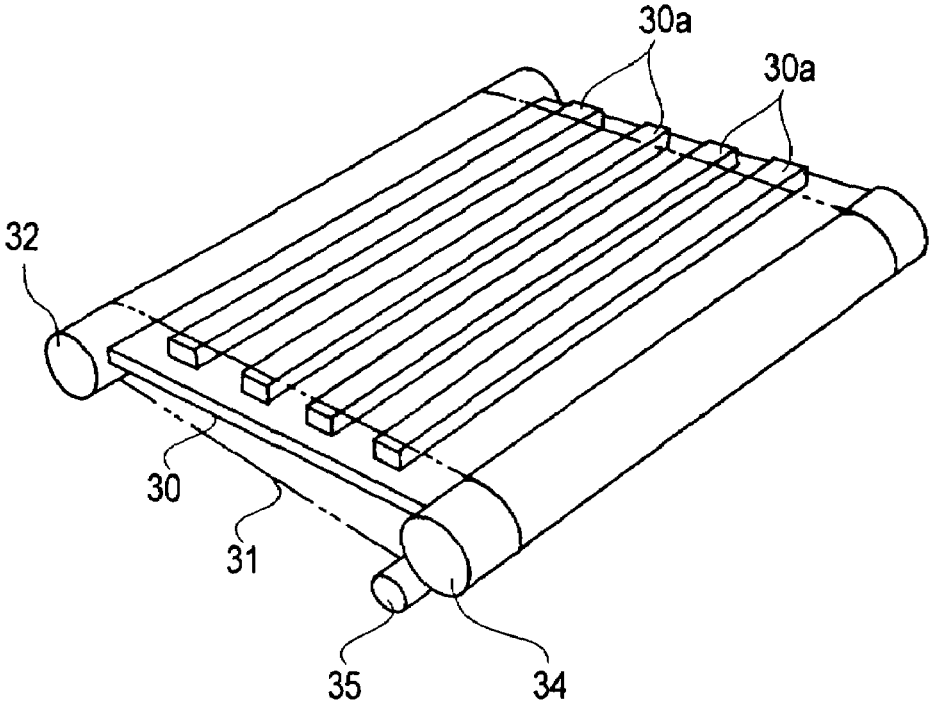
FIG. 7 is a perspective view of the conveying portion of the recording apparatus in FIG. 1, showing the general structure thereof.
Figure 8:
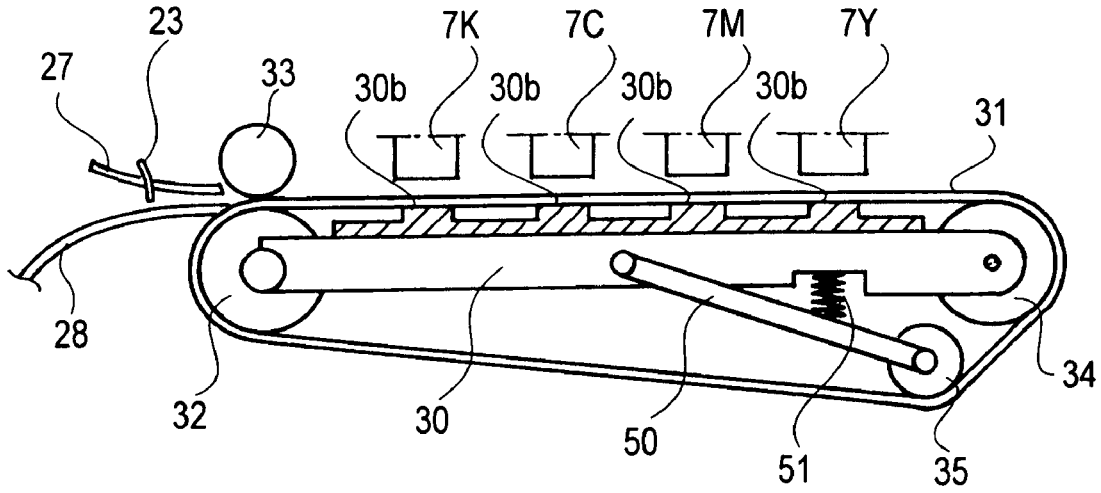
FIG. 8 is a schematic sectional view of the conveying portion shown in FIG. 6.

Referring to FIGS. 1, 7 and 8, the follower roller 32 and driver roller 34 are rotatably attached to the platen 30. The tension roller 35 is rotatably attached to one end of an arm 50, which is pivotally attached to the platen 30 by the other end. Further, the arm 50 is kept under the pressure generated by a spring 51. Therefore, the tension roller 35 keeps the conveyer belt 31 tensioned with the application of a predetermined amount of force (2.0 kgf: 19.6 N). The platen 30 is positioned immediately below the top portion of the track of the conveyer belt 31, playing the role of preventing the conveyer belt 31 from drooping downward.

The conveying portion 3 is provided with a pinch roller 33, which is rotated by the movement of the conveyer belt 31. The pinch roller 33 opposes the follower roller 32, with the conveyer belt 31 pinched between the pinch roller 33 and follower roller 32. It is kept pressed upon the conveyer belt 31 by the pressure generated by an unshown spring, and guides the recording paper P toward the recording portion 7 by being rotated by the movement of the conveyer belt 31. Further, the pinch roller 33 is electrically connected to the frame (unshown) of the main assembly of the recording apparatus 1, being enabled to remove the electrical charge which the surface layer 36*d* of the conveyer belt 31 collects.

Further, the conveying portion 3 is provided with top and bottom guides 27 and 28, respectively, for guiding the recording paper P, which are located at the entrance of the conveying portion 3. The top guide 27 is provided with a PE sensor lever 23 for detecting the leading and trailing edges of the recording paper P.

The conveying portion 3 is also provided with a pair of cleaning rollers 38, which are disposed in a manner of squeezing the conveyer belt 31. The pair of cleaning rollers 38 are enabled to absorb such contaminants as ink having adhered to the conveyer belt 31, in order to remove the contaminants. For durability, they are formed of sponge, the pores of which are small in diameter (10 μm-30 μm) and are continuous. Further, the conveying portion 3 is provided with a charge removal brush 37 as a charge removing means for clearing the conveyer belt 31 of electrical charge after the cleaning the conveyer belt 31 by the pair of cleaning rollers 38.

On the downstream side of the follower roller 32 of the conveying portion 3 in terms of the recording paper conveyance direction, a recording portion 7 for forming an image based on image formation data is disposed. The recording portion 7 is an image forming apparatus of the line type having a plurality of nozzles aligned in the direction perpendicular to the recording paper conveyance direction, or comprises a plurality of ink jet recording heads as recording means, that is, the recording head 7K for black color, recording head 7C for cyan color, recording head 7M for magenta color, and recording head 7Y for yellow color, which are attached to the head holder A, in the listed order, from the upstream side in terms of the recording paper conveyance direction, with the provision of predetermined intervals. Each of the recording heads 7K, 7M, 7C, and 7K comprises internal heaters or the like, and unshown nozzles. In operation, it applies heat to the ink therein, causing the ink to boil in the so-called film-boiling fashion, so that the ink is ejected through the nozzle by the pressure changes resulting from the growth and contraction of the bubbles generated by the film-boiling of the ink.

The head holder 7A to which the recording heads 7K, 7C, 7M, and 7Y are attached are rotatably attached by one end to a shaft 71, whereas the other end the head holder 7A is provided with a projection 7B, by which the head holder 7A is engaged with a rail 72, maintaining thereby a predetermined distance between the recording head surface having the nozzles, and the recording paper P.

The paper discharging portion 4 is a portion through which the recording paper P is discharged into a delivery tray 43 after the formation of an image on the recording paper P in the recording portion 7. The paper discharging portion 4 has a discharge roller 41 and a spur roller 42. The discharge roller 41 is driven by the rotational force transmitted thereto from the driver roller 34 through an unshown transmitting means. The spur roller rolls on the recording surface of the recording paper P after the recording thereon. Therefore, the spur roller is structured to minimize the contact area between it and recording paper P in order to minimize the amount by which the recording image formed on the recording paper P will be disturbed, as it comes into contact with the recording image.

The two-sided printing path 6 has a plurality of conveyance rollers for turning over the recording paper P for two-sided printing. It is used when the recording apparatus is in the two-sided printing mode. More specifically, in the two-sided printing mode, the recording paper P is turned over by being pulled back into the main assembly of the recording apparatus, and introduced into the two-sided printing path 6 (recording paper reversing), while the trailing edge of the recording paper P is still between the discharge roller 41 and spur roller 42. Then, the recording paper P is moved past between the conveyance roller 32 and pinch roller 33, and is placed again on the conveyer belt 31.

Next, the recording method employed by the ink jet recording apparatus 1 structured as described above will be briefly described. When the recording apparatus 1 is on standby, the pressure plate 21 is kept in the predetermined bottom position by the release cam of the paper feeding portion 2, preventing thereby the rotational paper feeding member 22 from coming into contact with the recording paper P on the pressure plate 21. Then, as the conveyance roller 32 is driven, the rotational force is transmitted to the rotational paper feeding member 22 and release cam, through a gear train or the like. As the rotational force is transmitted to the release cam, the release cam loses its contact from the pressure plate 21, allowing the pressure plate 21 to rise. As a result, the recording paper P on the pressure plate 21 comes into contact with the rotational paper feeding member 22. Thus, as the rotational paper feeding member 22 is rotated by the rotational force transmitted from the conveyance roller 32, the recording papers P are sequentially picked up, while being separated one by one by a separation claw 26, and are fed to the conveyance portion 3. The rotational paper feeding member 22 is rotated until the leading portion of the recording paper P is fed into the conveyance portion 3. Then, it is stopped in the standby position, that is, the position in which it does not contact the recording paper P, when the conveyance 32 is stopped, and therefore, the transmission of the rotational driving force thereto stops.

After the conveyance of the recording paper P to the conveyance portion 3 as described above, the recording paper P is guided by the top and bottom guides 27 and 28 into the contact area between the conveyance roller 32 and pinch roller 33. When the recording paper P is guided into the contact area between the conveyance roller 32 and pinch roller, 33, the leading edge of the recording paper P is detected by the PE sensor lever 23, whereby the location of theoretical line on the recording paper P at which recording is to be started is determined. After the delivery of the recording paper P to the conveying portion 3, the recording paper P is conveyed further by the conveyer belt 31 which is circularly driven by the paper conveyance motor through the conveyance roller 32.

As the recording paper P is conveyed through the recording portion 7 with proper timing, four inks different in color are ejected from the recording heads 7*k*, 7C, 7M, and 7Y, one for one, and are received by the recording paper P. As a result, a predetermined image (inclusive of letters, patterns, etc.) is formed on one of the two surfaces of the recording paper P.

After the completion of the formation of the image on one of the two surfaces of the recording paper P, the recording paper P is conveyed further toward the paper discharging portion 4. In the two-sided printing mode, however, as the trailing edge of the recording paper P reaches between the discharge roller 41 and spur roller 42, the discharge roller 41 is rotated in reverse to convey the recording paper P in the direction opposite to the normal direction in which the recording paper P is to be discharged, in order to introduce the recording paper P into the two-sided printing path 6. After being introduced into the two-sided printing path 6, the recording paper P is conveyed through the path 6 by the aforementioned plurality of conveyance rollers, and is placed again on the conveyer belt 31 through the contact area between the conveyance roller 32 and pinch roller 33, being thereby turned over. Then, the recording paper P is conveyed through the recording portion 7, while the four inks different in color are ejected from the recording heads 7*k*, 7C, 7M, and 7Y, one for one. As a result, another image (inclusive of letters, patterns, etc.) is formed on the reverse side of the recording paper P.

After the completion of the recording on both surfaces of the recording paper P, the discharge roller 41 is rotated in the normal direction by the driver roller 34. As a result, the recording paper P is discharged into the delivery tray 43 through the contact area between the discharge roller 41 and spur roller 42.

Next, referring primarily to FIGS. 7-11, the structure of the conveying portion 3, which characterizes the present invention, will be described in more detail. FIG. 7 is a perspective view of the conveying portion 3 in this embodiment, showing the general structure thereof, and FIG. 8 is a schematic sectional view of the conveying portion 3 in this embodiment.

Figure 9:
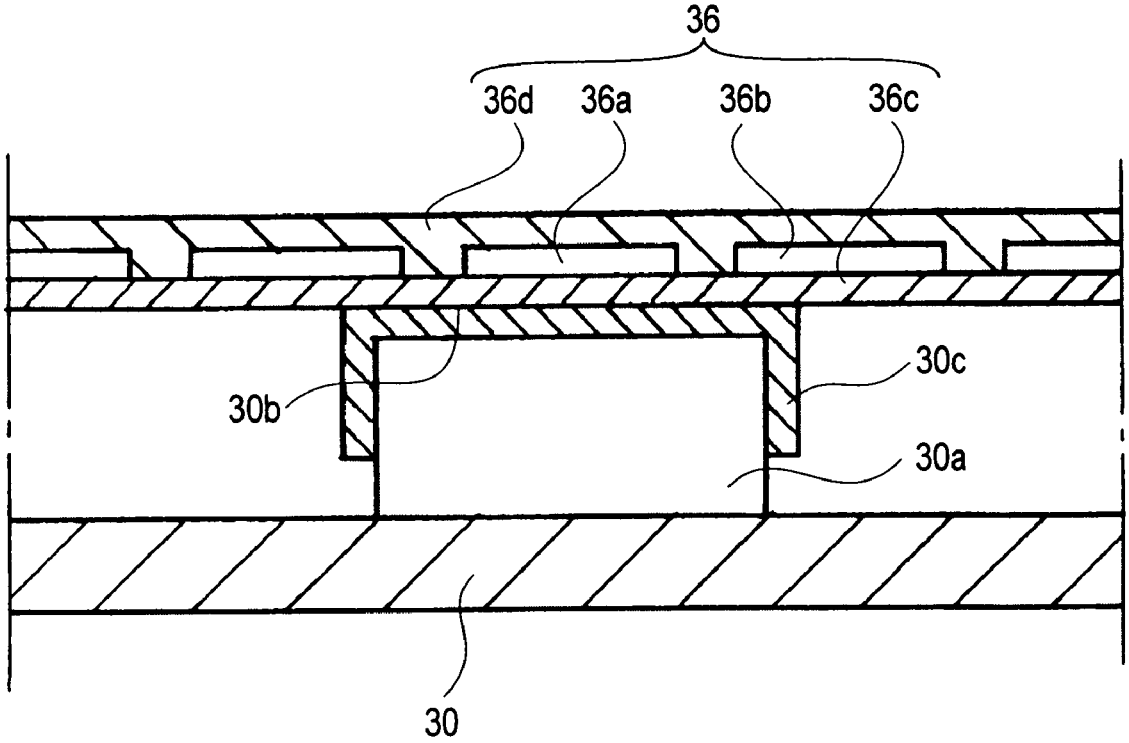
FIG. 9 is an enlarged view of the essential portions the conveying portion shown in FIG. 7.

First, the platen 30 as the frame of the conveying portion 3 will be described. Referring to FIGS. 7-9, the platen 30 is provided with a plurality of ribs 30*a*, which correspond in number and position to the recording heads 7K, 7C, 7M, and 7Y, one for one, and which extend in parallel in the direction parallel to the direction in which the nozzles of each recording head are aligned (direction perpendicular to moving direction of conveyer belt 31). The top surface 30*b* of each rib 30*a*, that is, the surface facing the recording head 7, is parallel to the recording head surface having the nozzles, and has a predetermined width in terms of the direction in which the conveyer belt 31 is moved. Further, the top surface 30*b* of each rib 30*a* is level with the top surfaces 30*b* of the other ribs 30*a*. In order to generate an ample amount of recording paper adhering force, each rib 30*a* is formed of an electrical conductive substance. The top surface 30*b* of the rib 30*a*, across which the conveyer belt 32 slides, is entirely covered with a low friction layer 30*c* (100 μm in thickness, and 0.2 in coefficient of friction) formed of Teflon (registered commercial name) film, high polymer polyethylene film, or the like, in order to minimize the friction which occurs as the conveyer belt 31 is moved, and also, to stabilize the conveying portion 3 in terms of the operational load, so that the recording paper P will be conveyed with a high level of accuracy.

Next, referring to FIGS. 3, 4, and 9, the conveyer belt 31 is laminated, comprising the surface layer 36*d* (to which recording paper P is adhered), base layer 36*c*, and a plurality of electrodes 36*a* sandwiched between the surface and base layers 36*d* and 36*c*. The surface layer 36*d* is formed of a material doped with an ion conductive substance (electrolyte: substance, ions of which function as carriers to allow conduction of electricity), and its electrical resistance is in the mid range, whereas the base layer 36*c* is dielectric. As electrical charge is given to the electrode 36*a*, electrostatic force is generated, which adheres recording medium (recording paper P) to the conveyer belt 31. The conveyer belt 31 also comprises a plurality of electrodes 36*b* as ground electrodes, which are also sandwiched between the top and bottom layers 36*d* and 36*c*.

Generally, substances are classified into dielectric, semiconductive, and conductive groups. The recording paper P as recording medium belongs to the dielectric group, being in the range of $10^{10}$-$10^{12}$ ohm·cm in electrical resistance. When the recording paper P as recording medium is roughly the same in electrical resistance as the surface layer 36*d* of the conveyer belt 31 (for example, $10^{11}$ ohm·cm), the adhesive force generated by the adhesive force generating means is effective. However, when the surface layer 36*d* is substantial in electrical resistance, it is difficult for electrical current to flow, and therefore, the adhesive force is weaker. On the other hand, when the surface layer 36*d* is small in electrical resistance, it is too easy for electric current to flow, and therefore, the adhesive force is also weaker.

As described above, the conveyer belt 31 is made up of the adhesive force generating apparatus 36, base layer 36*c*, and surface layer 36*d*. The adhesive force generating apparatus 36 comprises the plurality of electrodes 36*a* extending in parallel like the teeth of a comb, and plurality of ground electrodes 36*b* extending also in parallel like the teeth of a comb (FIGS. 3 and 4). The top and bottom layers 36*c* and 36*d* are bonded to each other with the use of adhesive, by thermal welding, or the like means. Thus, if the conveyer belt 31 is left stretched in the recording apparatus for a substantial length of time, it is possible that the conveyer belt 31 will creep, across the portions left bent, that is, the portions left in contact with the conveyance roller 31, driver roller 34, and pressure roller 35, due to the difference in rigidity (pliability) among the substances of which the various portions of the conveyer belt 31 are formed. In the case of a conveyer belt in accordance with the prior art, when it began to be driven while it was in the above described condition, that is, after it had crept, the portions of the conveyer belt 31, which had crept, failed to flatten, while they were facing the recording heads 7K, 7C, 7M, and 7Y, even though the conveyer belt 31 was under the tensional force applied thereto by the tension roller 35. In other words, the conveyer belt remained wavy (roughly 0.5 mm-1.0 mm in amplitude).

It is possible to control the recording apparatus so that the recording paper P will not be placed across the portions of the conveyer belt 31, which fail to flatten. In the case of an ink jet recording apparatus, however, the distance between each of the recording heads 7K, 7C, 7M, and 7Y and recording paper P is very small (0.5 mm-1.0 mm) as described above. Therefore, if the conveyer belt 31 fails to flatten, the recording paper P is made to rub the recording head surface having the nozzles, by the portions of the conveyer belt 31 which retain the creep, resulting in various problems. For example, the nozzles may be damaged, and also, the inks different in color may mix as they are carried from one recording head to the other by the recording paper P, solidifying sometimes due to chemical reaction, which can make it impossible to record an image. It is also possible to provide the conveying apparatus 3 with additional spur rollers in order to flatten the wavy portions of the conveyer belt 31 by pressing the conveyer belt 31 from above to keep the recording paper P flat while it is conveyed by the conveyer belt 31. In this case, the additional spur rollers are placed so that they vertically align with the intervals among the recording heads 7K, 7C, 7M, and 7Y, one for one. However, this method suffers from the following problems, and the like problems, in particular, in high speed recording, that it reduces an image forming apparatus in image quality; it causes an image forming apparatus to yield images having the traces of the spur rollers; and it causes the surface layer of the conveyer belt 31 to deteriorate, resulting in high voltage leak. In other words, the structural arrangement of providing the conveying portion 3 with additional spur rollers, which vertically align with the intervals among the recording heads 7K, 7C, 7M, and 7Y, one for one, is not suitable for a high speed ink jet recording apparatus of the full-line type.

It is also possible to detect by a recording paper anomaly detection sensor, the occurrence of the recording paper anomaly, for example, cockling, floating, etc., and shut off the power source for the driving force generating means, such as the paper conveying motor 60, as the anomaly occurs. This method has the following problems when applied to a high speed ink jet recording apparatus. That is, the conveyer belt 31 of an ink jet recording apparatus is circularly moved at a high speed. Therefore, inertia makes it impossible for the recording paper P on the conveyer belt 31 to instantly stop with the conveyer belt 31, possibly rubbing the surface of the recording head 7 (7K, 7C, 7M, and 7Y) having the nozzles, which could result in the aforementioned problems that the nozzle portions of the recording head 7 (7K, 7C, 7M, and 7Y) will be damaged; inks different in color mix, solidifying sometimes due to chemical reaction, by being carried by the recording paper P. In other words, this method also is not suitable for a high speed ink jet recording apparatus.

Figure 10:
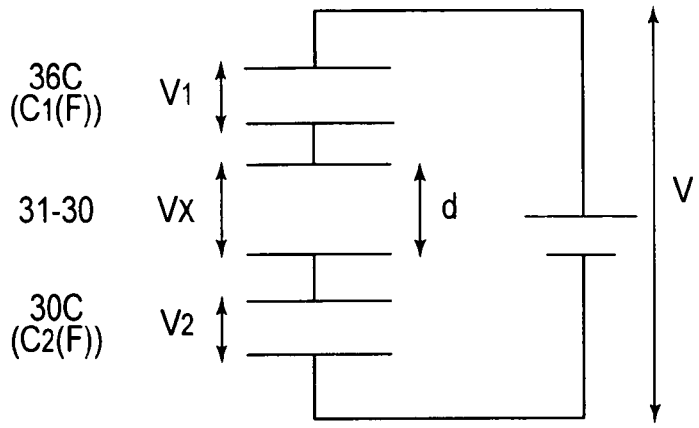
FIG. 10(*a*) is a circuit diagram in which the combination of the conveyer belt and platen is deemed to be a condenser, and FIG. 10(*b*) is a graph showing the relationship between the amount of electrostatic adhesive force and the distance between the conveyer belt and platen.
Figure 10:
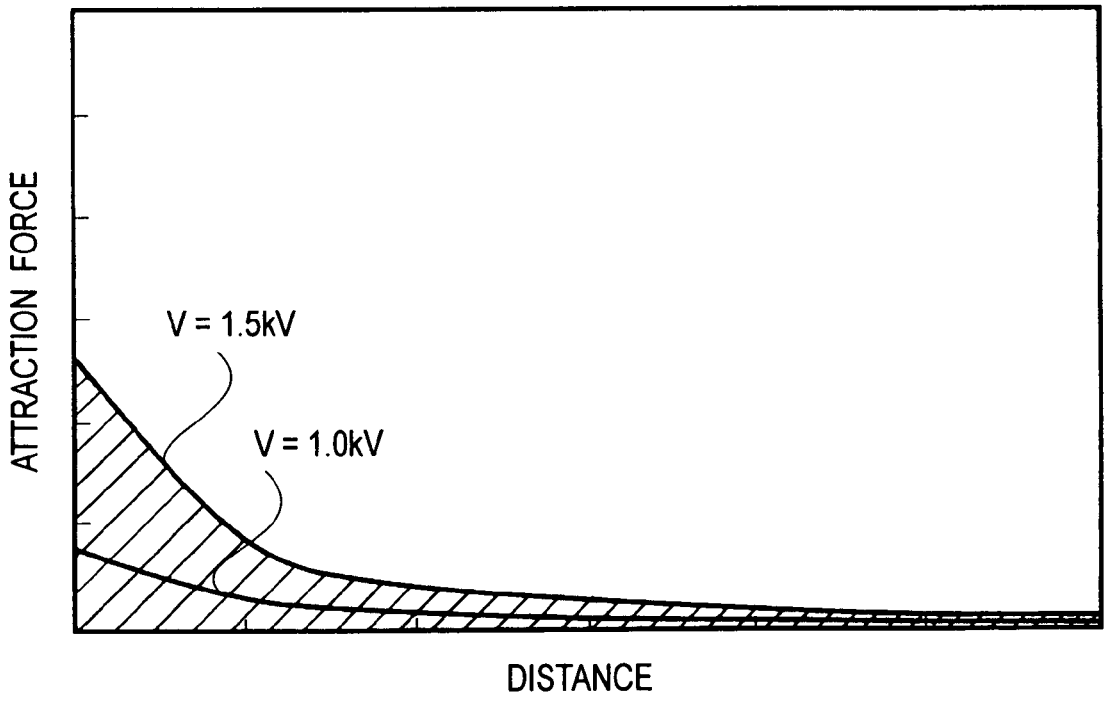

Next, the principle of the present invention for solving the above described problems, more specifically, the principle for preventing the conveyer belt 31 having crept across the portions which were in contact with the conveyance roller 32, driver roller 34, and tension roller 35 while the recording apparatus was left unattended, from fluttering while being circularly moved to convey the recording paper P, will be described. In this embodiment, the conveyer belt 31 is implanted with a plurality of electrodes arranged in the pattern of the teeth of a comb, and electrostatic force is generated by applying high voltage (0.5 kV-10 kV) to the electrodes of the conveyer belt 31 so that the recording paper P is electrostatically adhered to the top surface of the conveyer belt 31, and also, so that the conveyer belt 31 is electrostatically attracted toward, or adhered to, the ribs 30*a* of the platen 30, being thereby minimized in vertical undulation. Therefore, the recording paper P is reliably conveyed. The amount of electrostatic adhesive force which the conveyer belt 31 generates can be calculated from the mathematical formula given below, which was formulated based on the schematic electrical model of the conveyer belt 31, in FIG. 10(*a*), and in which d stands for the distance between the conveyer belt 31 and platen 30, and F stands for the amount of the adhesive force. FIG. 10(*b*) shows the relationship between the distance d and the amount of the electrostatic adhesive force F.

$F=\in S(V-V1-V2)2/2d2$, wherein $\in$ stands for dielectric constant; S, area size; V, value of the voltage applied to the electrode 36*a*; V1, value of the voltage of the base layer 36*c* of the conveyer belt 31; and V2 stands for the value of the voltage of the low friction layer 30*c* of the platen 30. The formula, however, holds only when the ambient temperature is normal. In other words, when the ambient temperature is abnormally high or low, the actual amount of the electrostatic adhesive force generated by the electrostatic adhesive force generating apparatus 36 is smaller than the amount calculated using this formula. The inventors of the present invention discovered the reason for this discrepancy, which is as follows. That is, although the primary material for the conveyer belt 31 is dielectric, the surface layer 36*d* is doped with ion conductive substance, and therefore, its electrical resistance is in the mid range. Therefore, as the ambient temperature changes, the surface layer 36*d* of the conveyer belt 31 changes in electrical resistance, increasing thereby the difference in electrical resistance between the surface layer 36*d* of the conveyer belt 31 and the recording medium. As a result, it becomes more difficult for the conveyer belt 31 to electrostatically attract the recording paper P.

Figure 11:
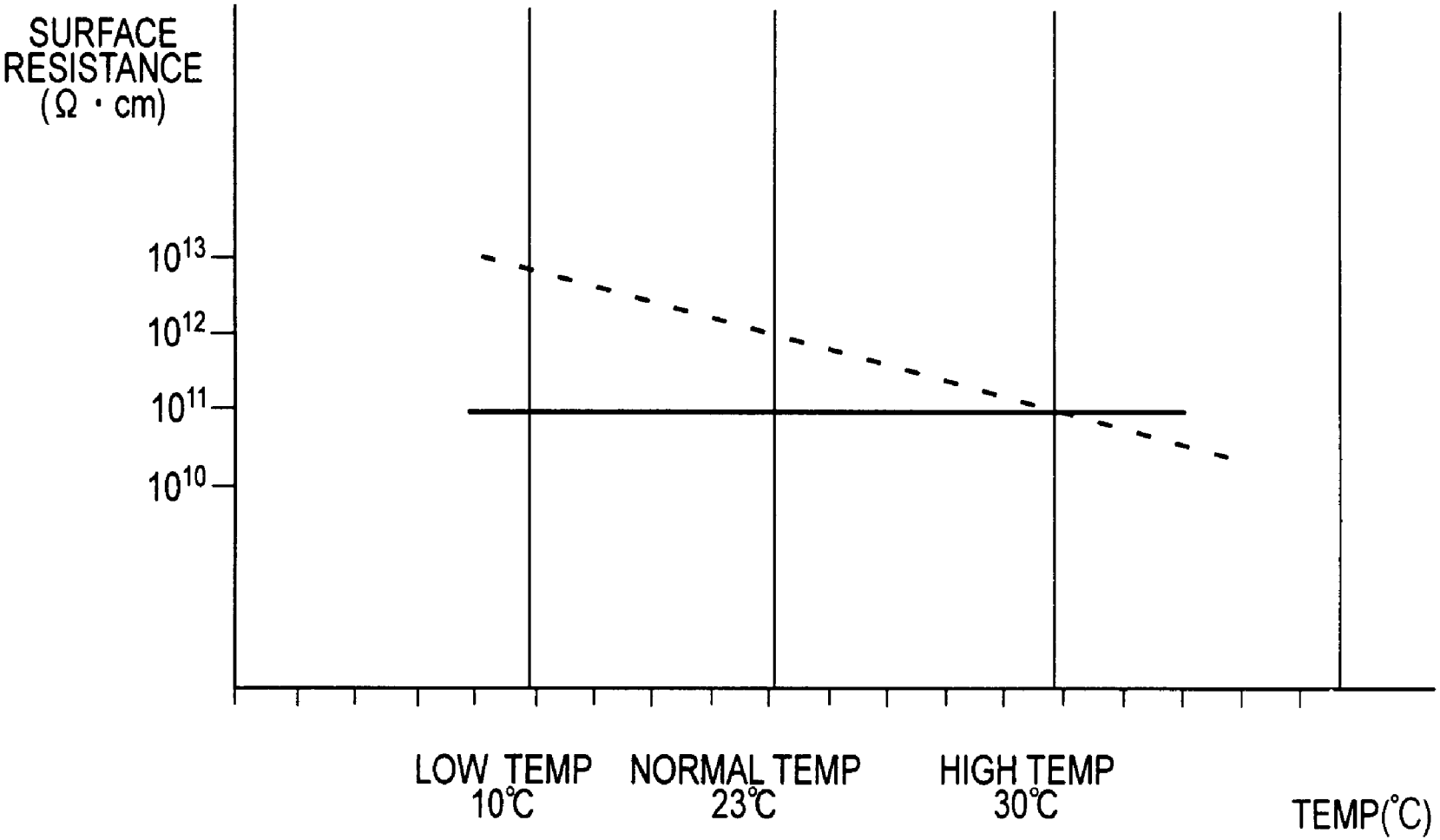
FIG. 11 is a graph showing the relationship between the amount of the electrical resistance of the conveyer belt and the ambient temperature.
Figure 12:
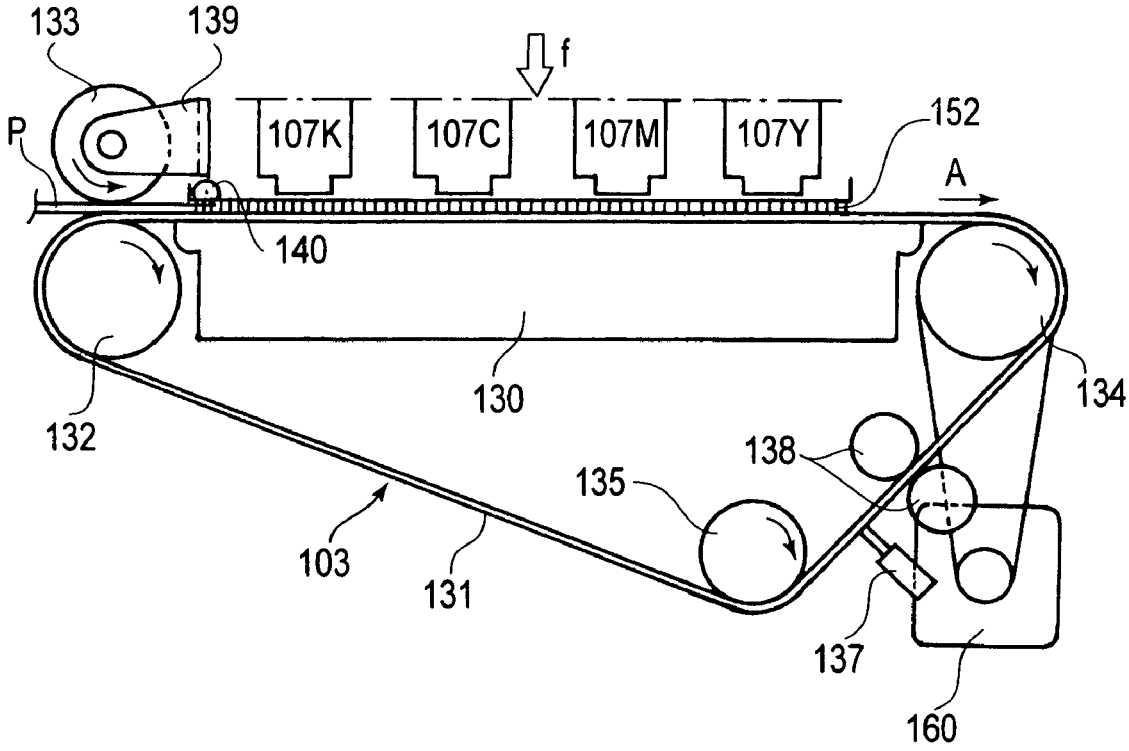
FIG. 12 is a sectional view of the conveying portion of a typical recording apparatus in accordance with the prior art, showing the general structure thereof.
Figure 13:
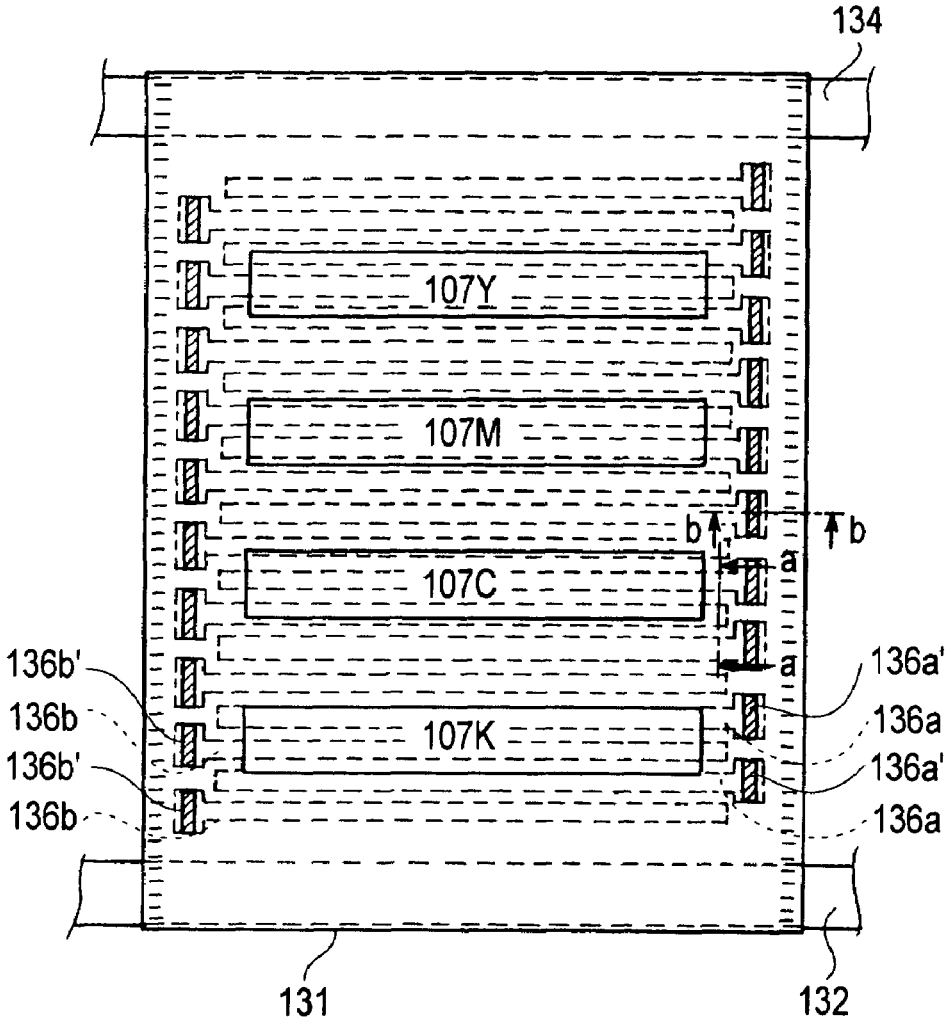
FIG. 13 a plan view of the conveying portion of the recording apparatus shown in FIG. 12.
Figure 14:
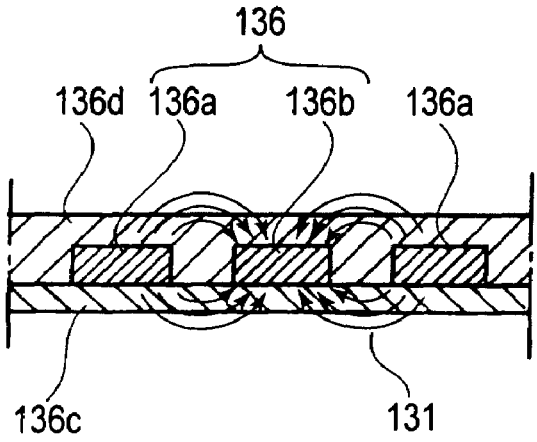
FIG. 14 is a sectional view of the conveying portion shown in FIG. 12, at a line a-a in FIG. 13.
Figure 15:
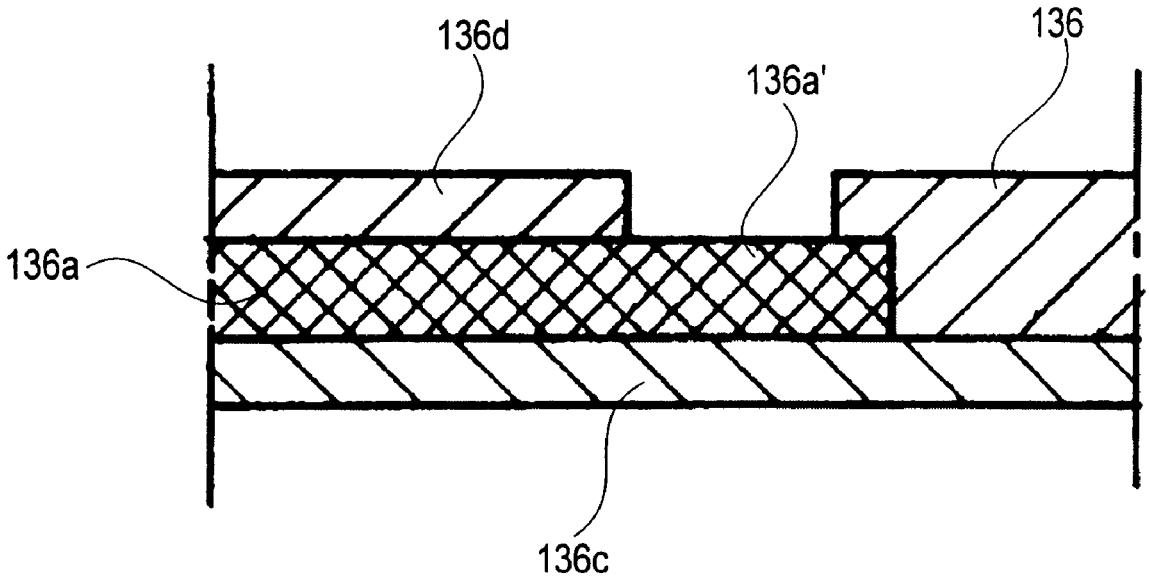
FIG. 15 is a sectional view of the conveying portion shown in FIG. 12, at a line b-b in FIG. 13.

The amount of the electrical resistance of the surface layer 36*d* of the conveyer belt 31 can be controlled by controlling the amount by which the material for the surface layer 36*d* is doped with ion conductive substance. However, the electrical resistance of the surface layer 36*d* is also affected by the temperature; it substantially increases as the temperature decreases, as shown in FIG. 11 (vertical axis represents amount of electrical resistance of surface layer 36*d* of conveyer belt 31, and horizontal axis represents level of ambient temperature of conveyer belt 31), which shows the relationship between the amount of the electrical resistance of the surface layer 36*d* of the conveyer belt 31, and ambient temperature. Therefore, when the ambient temperature is low, the difference in electrical resistance between the surface layer 36*d* of the conveyer belt 31 and the recording paper P is substantial, making it difficult for the electrostatic adhesive force to be generated by a sufficient amount.

In this embodiment, therefore, the conveying portion 3 is provided with a detecting means for detecting the surface temperature of the conveyer belt 31 and a temperature controlling means, in order to keep the temperature of the conveyer belt 31 within the predetermined range. More specifically, when the temperature detected by the detecting means falls outside the predetermined range, the temperature of the conveyer belt 31 is adjusted by the temperature controlling means capable of heating as well as cooling, temperature controlling means capable of heating only, or temperature controlling means capable of cooling only, so that the temperature of the conveyer belt 31 returns to the predetermined range.

Figure 5:
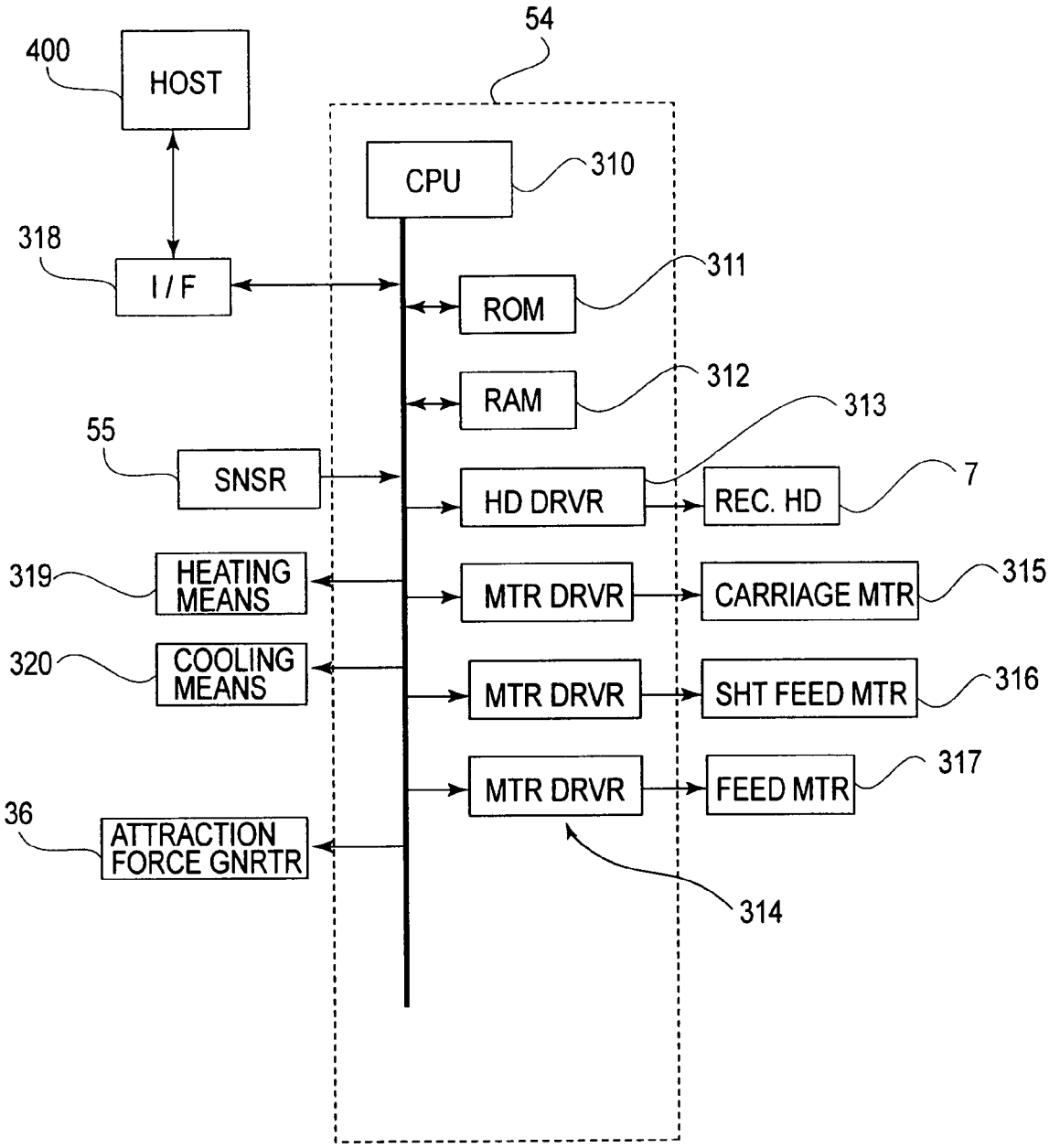
FIG. 5 is a block diagram of the control portion of the recording apparatus in FIG. 1.

FIG. 5 is a circuit diagram of the temperature controlling means in this embodiment.

Referring to FIG. 5, the control portion 54 comprises: a CPU 310 which issues various control commands; a ROM 311 in which control data or the like are stored; a RAM 312 which functions as the area in which recording data and the like are developed; etc.

Designated by referential numbers 316 and 317 are a paper feeding motor for driving the paper feeding roller 22, and a conveyance motor for driving the driver roller 34, respectively.

Designated by a referential number 313 is a head driver which drives the recording portion (comprising recording heads 7Y, 7M, 7C, and 7K), and designated by a referential number 314 is a motor driver which drives carriage motor 315, paper feeding motor 316, or conveyance motor 317. Designated by a referential number 318 is an interface through which data are exchanged between the recording apparatus and a host apparatus 400 such as a computer, a digital camera, and the like.

Designated by referential numbers 319 and 320 are a heating means for heating the belt, and a cooling means for cooling the belt, respectively.

FIG. 6 shows an example of the heating means.

Referring to FIG. 6, the recording apparatus 1 is structured so that the temperature of the conveyer belt 31 in the recording apparatus 1 is detected by the detecting means, or a temperature detecting device (sensor 55), and as the change in temperature is detected by the sensor 55, the control portion 54 applies voltage to the electrodes as heating means in the conveyer belt 31 in accordance with the amount of the detected change in temperature. Therefore, the temperature of the surface layer 36*d* of the conveyer belt 31 remains roughly constant. Therefore, the surface layer 36*d* of the conveyer belt 31 remains constant in electrical resistance regardless of the changes in ambient temperature. Therefore, the electrostatic adhesive force of the conveyer belt 31 remains roughly constant, ensuring that the recording paper P is satisfactorily adhered to the conveyer belt 31. For example, when the ambient temperature is no more than the highest temperature value in FIG. 11, which shows the relationship between the amount of the electrical resistance of the surface layer 36*d* of the conveyer belt 31 and the ambient temperature, adjustments are made so that the temperature of the surface layer 36*d* changes in the direction to reduce the electrical resistance of the surface layer 36*d*, in order to keep the surface layer 36*d* constant (solid line in FIG. 11) in electrical resistance regardless of changes in the various ambient conditions. More concretely, when the temperature of the surface layer 36*d* of the conveyer belt 31 detected by the sensor 55 is no more than a first predetermined value, a predetermined amount of voltage is applied to the electrodes, whereas when it is no less than a predetermined second value, which is greater than the first value, the voltage applied to the electrodes is reduced or zeroed. Instead, voltage proportional to the temperature of the surface layer 36*d* of the conveyer belt 31 may be applied to the electrodes.

In other words, AC voltage is applied to the electrodes 36*a* in addition to the voltage applied to the electrodes 36*a* to keep the potential of the electrodes 36*a* at a predetermined level to generate electrostatic adhesive force, so that heat is generated by the AC voltage, which is sinusoidal in waveform, while the electrostatic adhesive force is generated.

The temperature controlling apparatus, with which the conveying apparatus in this embodiment is provided, is not an additional apparatus. That is, the electrodes 36*a*, as electrostatic adhesive force generating apparatuses, such as those in accordance with the prior art, implanted in the conveyer belt 31 are utilized to control the temperature of the conveyer belt 31, minimizing thereby cost increase. As a predetermined voltage is applied to these electrodes 36*a*, heat is generated therein by the current which flows through them by the amount proportional to their initial electrical resistance; they generate heat by the amount specific to the applied voltage. The control portion 54 controls the voltage applied to the electrodes 36*a* in the conveyer belt 31 so that the electrodes 36*a* in the portions of the conveyer belt 31, directly below the recording heads 7K, 7C, 7M, and 7Y as image forming apparatuses, are provided with the voltage for generating the electrostatic adhesive force, whereas the electrodes 36*a* in the other portions of the conveyer belt 31, that is, the electrodes 36*a* in the unshown portions of the conveyer belt 31, are provided with the voltage for the temperature adjustment. With the employment of this controlling method, the electrodes 36*a* can be used not only as electrostatic adhesive force generating apparatuses, but also, as temperature controlling apparatuses. Therefore, it is possible to maintain the electrostatic adhesive force large enough to keep the recording medium satisfactorily adhered to the conveyer belt 31. The voltage range may be adjusted in accordance with the layout of the recording apparatus 1.

It is possible to place a heat source or an air blower for blowing heated air, as the temperature controlling apparatus, in the adjacencies of an object (conveyer belt 31) to be heated, in order to control the temperature of the object. However, a heat source or an air blower is flawed in that when a heat source or an air blower is employed as the temperature controlling apparatus, it takes a substantial length of time to raise or lower the temperature of the object to a certain level. In comparison, according to the present invention, the object (conveyer belt 31) to be heated is directly heated by the electrodes 36*a* imbedded in the conveyer belt 31, eliminating energy loss. Therefore, the time necessary to raise or lower the temperature of the object is far shorter.

Incidentally, if the ambient temperature suddenly changes, dew forms sometimes on the surface layer 36*d* of the conveyer belt 31, allowing the voltage applied for generating the electrostatic adhesive force to leak through the small amount of moisture (dew) on the surface layer 36*d*. In this situation, it is possible that the electrostatic adhesive force will not be generated. In the case of this embodiment, however, the surface layer 36*d* of the conveyer belt 31 is controlled in temperature. Therefore, the surface temperature of the surface layer 36*d* of the conveyer belt 31 never changes by the amount large enough for dew formation, eliminating the possibility that the electrostatic adhesive force will reduce due to dew formation.

As for the temperature detecting means, it may be of the contact type or noncontact type. That is, a thermocouple (temperature sensor) may be placed directly in contact with the surface layer 36*d* of the conveyer belt 31, or the surface temperature of the conveyer belt 31 may be calculated from the amount of infrared ray radiating from the object (conveyer belt 31) the temperature of which is to be detected. Further, the temperature of the surface layer 36*d* may be obtained by converting the measured electrical resistance of the surface layer 36*d*, that is, the object, the temperature of which is to be detected.

As for the heating means 319, a heat source other than the heating means 319, for example, a heater, an air blower which blows hot air, etc., may be employed. Further, the conveying portion 3 may be provided with a cooling means 30 such as an air blower which blows cold air, so that if the temperature increases to a level higher than a third predetermined level, which is higher than the abovementioned first predetermined level, the conveyer belt 31 is cooled.

The preceding embodiment was described with reference to the color ink jet recording apparatus employing the plurality of recording heads 7K, 7C, 7M, and 7Y which are different in the color of the ink used for recording. However, the preceding embodiment is not intended to limit the scope of the present invention. Rather, the present invention is also applicable to an ink jet recording employing only a single recording head, an ink jet recording apparatus employing a plurality of recording heads, which are identical in ink color, but different in color density, for forming a multi-tone image. In other words, the present invention is applicable regardless of the number of recording heads, and the application will achieve the same beneficial effects as those described above.

In terms of the type of an image forming apparatus (recording head), not only is the present invention applicable to an image forming apparatus of the cartridge type, that is, an image forming apparatus, the recording head and ink container of which are integral, but also, to an image forming apparatus, the recording head and ink container of which are independent from each other, and are connected by an ink supply tube or the like. In other words, the present invention is applicable regardless of the structures of the recording head and ink container, and the application will achieve the same beneficial effects as those described above.

In terms of the movements of the recording head and recording medium relative to each other, not only is the present invention effectively applicable to a recording apparatus of the so-called serial type, that is, a recording apparatus in which in order to record an image, the recording head is moved in the direction perpendicular to the direction in which recording medium is conveyed, but also, to a recording apparatus of the full-line type, that is, a recording apparatus, the recording head of which matches in length the maximum width by which recording medium is recordable, or a recording apparatus employing a plurality of recording heads, the combined width of which matches in length the maximum width by which recording medium is recordable. Further, in terms of the method by which the recording heads are attached to the recording apparatus, not only is the present invention is effectively applicable to an ink jet recording apparatus employing a single or plurality of recording heads solidly attached to the main assembly of the recording apparatus, but also, an ink jet recording apparatus employing a recording head of the chip type, which is removably mountable in the main assembly of the recording apparatus, and which becomes electrically connected to the main assembly of the recording apparatus, and is enabled to be supplied with the ink from the main assembly, as it is mounted into the main assembly, and an ink jet recording apparatus employing a recording head of the cartridge type integrally comprising an ink container.

Further, in terms of the method for ejecting ink, not only is the present invention is applicable to an ink jet recording apparatus employing an image forming apparatus which uses an electro-mechanical transducer, such as a piezoelectric element, or the like, but also, an ink jet recording apparatus employing an image forming apparatus which uses an electro-thermal transducer. However, the present invention is especially effective when applied to an ink jet recording apparatus employing an image forming apparatus which uses an electro-thermal transducer to eject ink with the use of thermal energy, because such an ink jet recording apparatus can achieve a much higher level of density as well as a much higher level of precision.

Further, in terms of the type of an ink jet recording apparatus, not only is the present invention is applicable to an ink jet recording apparatus used as a peripheral outputting device for an information processing device such as a computer, but also, an ink jet recording apparatus, on the carriage of which a device such as a scanner, that is, a device other than an ink jet recording head, is mountable so that the recording apparatus can be used as an input device, an ink jet recording apparatus combined, as an integral part of a copying machine, with a reader or the like, an ink jet recording apparatus as an integral part of a facsimileing machine having transmitting as well as receiving functions, and the like ink jet recording apparatus.

In terms of the member for bearing and conveying the recording medium, not only is the present invention is applicable to an ink jet recording apparatus employing a recording medium conveying member in the form of a belt such as the one in the preceding embodiment, but also, to an ink jet recording apparatus employing a rigid recording medium conveying member in the form of a drum.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 063938/2004 filed Mar. 8, 2004, which is hereby incorporated by reference.

What is claimed is:

1. A recording apparatus comprising:

a conveyer belt for feeding a recording material;

a plurality of electrodes embedded in said conveyer belt and extending in a widthwise direction of said conveyer belt;

voltage applying means for applying a voltage to a part or all of said plurality of electrodes so as to provide a potential difference between adjacent electrodes to attract the recording material to said conveyer belt;

detecting means for detecting a temperature of said conveyer belt;

control means, responsive to an output of said detecting means, for controlling the temperature within a predetermined range to keep the electrical resistance of a surface layer of said conveying belt substantially constant; and an image forming device, disposed opposed to said conveyer belt, for recording an image on the recording material conveyed on said conveying belt, wherein said plurality of electrodes which are passing by said image forming device are supplied with a voltage to provide the potential difference between adjacent electrodes, and said plurality of electrodes which are not passing by said image forming device are supplied with a voltage for controlling the temperature.

2. A recording apparatus according to claim 1, wherein said control means includes cooling means for cooling said conveyer belt, and when the output is indicative of a temperature which is higher than a third predetermined temperature which is higher than the second predetermined temperature, said control means controls said cooling means to execute a cooling operation thereof.

3. A recording apparatus comprising:

a conveyer belt for feeding a recording material;

a plurality of electrodes embedded in said conveyer belt, and extending in a widthwise direction of said conveyer belt;

voltage applying means for applying a voltage to a part or all of said plurality of electrodes so as to provide a potential difference between adjacent electrodes, so that the recording material is attracted to said conveyer belt;

detecting means for detecting a temperature of said conveyer belt;

control means, responsive to an output of said detecting means, for controlling the temperature within a predetermined range to keep the electrical resistance of a surface layer of said conveying belt substantially constant, an image forming device for recording an image on the recording material conveyed on said conveying belt; and a plurality of ribs across which said conveyer belt slides, said ribs facing said image forming device and formed of an electrical conductive substance;

wherein said conveyer belt goes between said ribs and said image forming device, wherein said control means includes heating means for heating said conveyer belt, and when the output is indicative of a temperature which is lower than a first predetermined temperature, said control means controls said heating means to heat said conveyer belt, wherein when the output is indicative of a temperature which is higher than a second predetermined temperature which is higher than the first predetermined temperature, said control means controls said heating means to stop heating operation thereof, wherein said heating means includes said plurality of electrodes and is effective to generate heat by a predetermined voltage applied across said plurality of electrodes, and wherein said plurality of electrodes which are passing by said image forming device are supplied with a voltage to provide the potential difference between adjacent electrodes, and said plurality of electrodes which are not passing by said image forming device are supplied with a voltage for controlling the temperature.

* * * * *